US006138720A

United States Patent [19]

Zeigler

[11] Patent Number: 6,138,720

[45] Date of Patent: Oct. 31, 2000

[54] REDUCED VOLATILE EMISSIONS PNEUMATIC AEROSOL CAN FILLING MACHINE

[76] Inventor: Edward William Zeigler, 9840 York Alpha, Unit F, North Royalton, Ohio 44133

[21] Appl. No.: 09/320,305

[22] Filed: May 26, 1999

[51] Int. Cl.[7] ..... B65B 1/04; B65B 3/04; B65B 31/00; B67C 3/00

[52] U.S. Cl. ..... 141/20; 141/18; 141/21; 141/25; 141/27; 141/97; 141/275; 141/369; 141/370; 141/372; 141/378

[58] Field of Search ..... 141/18, 20, 21, 141/25, 27, 97, 275, 369–372, 378

[56] References Cited

U.S. PATENT DOCUMENTS

| | | | |
|---|---|---|---|
| 3,244,494 | 4/1966 | Apple et al. . | |
| 3,604,477 | 9/1971 | Grothoff | 141/20 |
| 3,620,266 | 11/1971 | Ryder | 141/20 |
| 3,797,534 | 3/1974 | Skidmore | 141/3 |
| 4,727,914 | 3/1988 | Anderson, 111 et al. . | |
| 4,938,260 | 7/1990 | Hirz . | |
| 5,263,519 | 11/1993 | Reyner . | |
| 5,535,790 | 7/1996 | Hirz . | |
| 5,832,965 | 11/1998 | Fasse et al. . | |

*Primary Examiner*—Charles R. Eloshway
*Assistant Examiner*—Timothy L. Maust
*Attorney, Agent, or Firm*—John D. Gugliotta

[57] ABSTRACT

An apparatus for charging pressurized aerosol cans with liquid is provided having a base for providing mechanical stability, a can support assembly for supporting an aerosol can being filled with liquid, and a can charging assembly having a can receiving element and including a liquid reservoir having a tapered bottom in fluid communication with a pump rod receiving aperture for receiving a main piston pump rod. The main piston pump rod has a linearly elongated shaft terminating at its lower end in a radially expanded head and a sealing ring receiving slot into which a pliable sealing ring is recessed.

7 Claims, 4 Drawing Sheets

REDUCED VOLATILE EMISSIONS PNEUMATIC AEROSOL CAN FILLING MACHINE

FIELD OF THE INVENTION

The present invention relates to the art of filling pressurized containers, and, more particularly, with an improved filling machine for filling aerosol cans that allows for a reductions in the emissions of volatile compounds, either from within the can's contents or its propellant.

BACKGROUND OF THE INVENTION

Heretofore, pneumatically operated machines have been available for injecting paint and the like into precharged aerosol cans. As illustrated in U.S. Pat. No. 3,797,534, such devices commonly included a manual lever for lifting an aerosol can to be charged into contact with a relatively small reservoir, e.g. one quart. A pneumatically operated piston drove the paint from a cylinder at the bottom of the reservoir through the aerosol valve into the can.

Further developments involve automation of such equipment. Typical of the direction the art has taken is shown in U.S. Pat. No. 4,938,260. Such devices merely attempted to add mechanical elements and sensors to replace the manual input of the operator. For example, sensors detect the location of the can and allow a pneumatically adjustable platform to position the can to be filled, and a metering pump is monitored and controlled in order to measure the filled charge within each can.

However, although these and other improvements have been directed toward a more automated filling device, other problems within the art remain unaddressed. For example, the emission of volatile organic compounds, or VOC's, has been a source of government regulation, and continues to be a problem for such devices. Further, the reason why a single unit aerosol filling machine continues to be developed is because of a market driven need toward custom coloring and filling of paint into aerosol cans. To meet such a need, the older manual devices perform superior to a pneumatically controlled device in terms of cost, availability, reliability, maintenance, and other real-world factors that arise when a point of purchase retailer is asked to operate and maintain an automated filling device better suited toward high volume, industrial applications.

Finally, another disadvantage of the prior art resided in that open topped reservoirs tended to lose solvent by evaporation and skin over, as well as both solvent and propellant due to over-pressure blow-by. And, a mechanical aerosol can lifting mechanism adds an element of potential operator error. If the lever were misadjusted such that the operator could urge the aerosol can against the reservoir too firmly, the aerosol can could be bent or damaged. Such over pressure or analogous underpressure between the can and the reservoir could cause leakage of the paint. During an attempted filling, the paint could spray under pressure over the base and other portions of the filling apparatus. The spilled paint could readily interact with the lever and lift mechanism causing binding and sticking.

A search of the prior art did not disclose any patents that read directly on the claims of the instant invention; however, the following other references were considered related:

| U.S. Pat. No. | Inventor | Issue Date |
|---|---|---|
| 5,832,965 | Fasse et al. | 11/10/98 |
| 5,535,790 | Hirz | 07/16/96 |
| 4,938,260 | Hirz | 07/03/90 |
| 3,244,494 | Apple et al. | 04/05/66 |
| 4,727,914 | Anderson, III et al. | 03/01/88 |
| 5,263,519 | Reyner | 11/23/93 |

The present invention provides a new and improved aerosol can filling apparatus which overcomes the above referenced operator safety and other drawbacks of the prior art.

SUMMARY OF THE INVENTION

In accordance with the present invention, there is provided an apparatus for charging pressurized aerosol cans. The apparatus includes a base in which an aerosol can support platform is movably mounted. A can support moving means selectively raises and lowers the can support platform at least between preselected raised and lowered positions. A liquid reservoir, which has an aerosol can engaging outlet, is mounted in a cabinet such that the reservoir outlet sealingly engages the aerosol can in the raised position. A driving piston under manual or piston control urges a selected amount of liquid from the reservoir through the outlet into the aerosol can which is in a raised position.

In accordance with one aspect of the present invention, the can support moving means includes an upwardly engaged, spring urged platform which maintains the can support in the raised position at the proper location to engage with the filling mechanism, a depressing lever attached thereto allows loading of the can support control means.

Other aspects of the present invention include a hydraulic valve actuation method that allows opening of the closure mechanism of a pre-charged aerosol can without a mechanical impingement.

Another advantage of the present invention is that it reduces damage to the filled aerosol cans.

Yet another advantage of the present invention is that it allows for filling of pre-charged aerosol cans by using fewer piston strokes than conventional mechanisms.

Still further advantages of the present invention will become apparent upon reading and understanding the following detailed description of the preferred embodiments.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
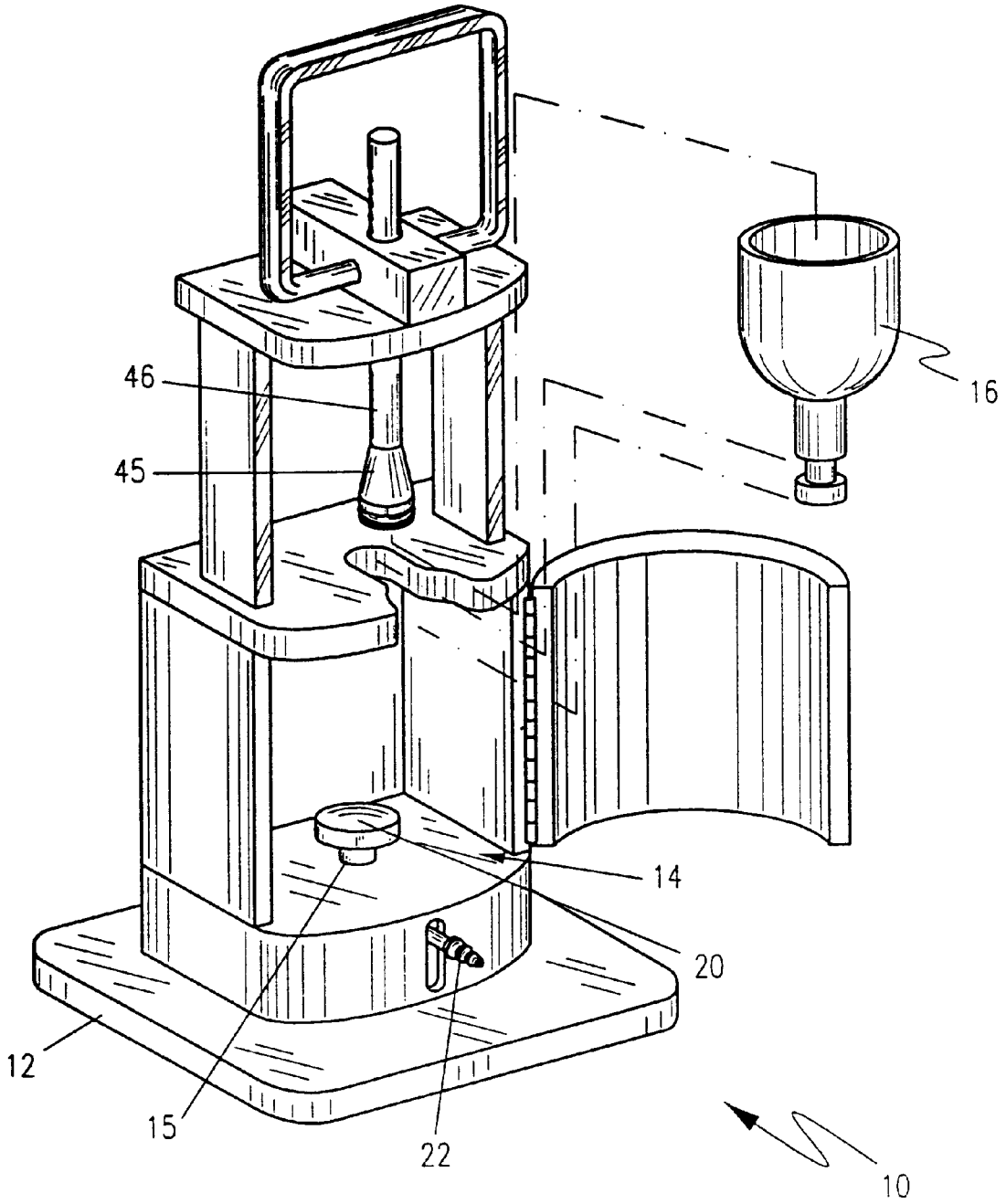
FIG. 1 is an exploded view of an aerosol can filling apparatus in accordance with the present invention.

With reference to FIG. 1, the apparatus, generally noted as 10, for charging pressurized aerosol cans is disclosed having a base 12 on which a can support assembly 14 is mounted which supports an aerosol (not shown) can being filled with paint or other liquid from a can charging assembly 16. The base 12 is designed for providing mechanical stability to the apparatus 10, and supports the can support assembly 14 having a can support platform 20 that is urged upward by a biasing spring 16 at a location that allows the filling orifice of the can to be mechanically forced into a can receiving element as will be further described below. A retracting lever 22 mechanically connected to the can support platform 20 allows for the operator to retract the can support platform 20 against the urging of the spring. By this design, the use of position sensors and positioners are avoided, and the can is automatically urged into the proper filling position and can be disengaged by depressing the lever 22.

Figure 2:
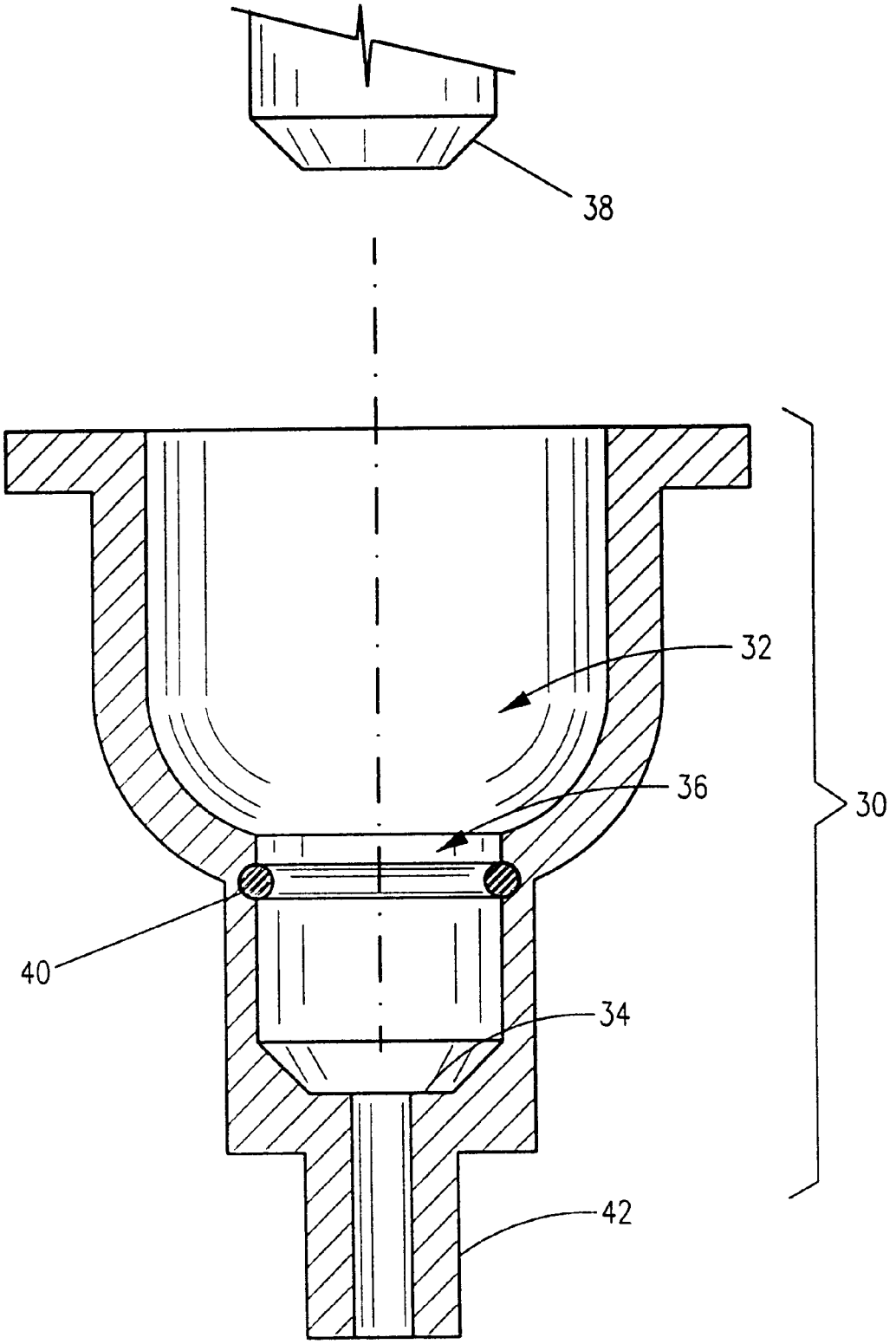
FIG. 2 is a cross sectional elevational view of the filling reservoir and piston mechanism available in the Prior Art.

With reference to FIG. 2, the currently available prior art for a can charging assembly 30 is shown for purposes of comparison and demonstration. Currently, a liquid reservoir 32 having a tapered bottom 34 in fluid communication with a pump rod receiving aperture 36 for receiving a main piston pump rod 38. A sealing O-ring 40 embedded into the sidewall of the liquid reservoir 32 provided a sealing means between the liquid reservoir 32 and the main piston pump rod 38, thereby forming a pressurized volume for the delivery of liquid contents. Finally, a mechanical filling protrusion 42 is generally utilized to open the poppet valve in order to gain access to the interior of the aerosol can. This mechanical opening means is the basis for leakage of VOC and propellants from the can, and further can cause pressurization of the liquid reservoir prior to complete sealing, thereby causing additional operator and environmental risks.

Figure 3:
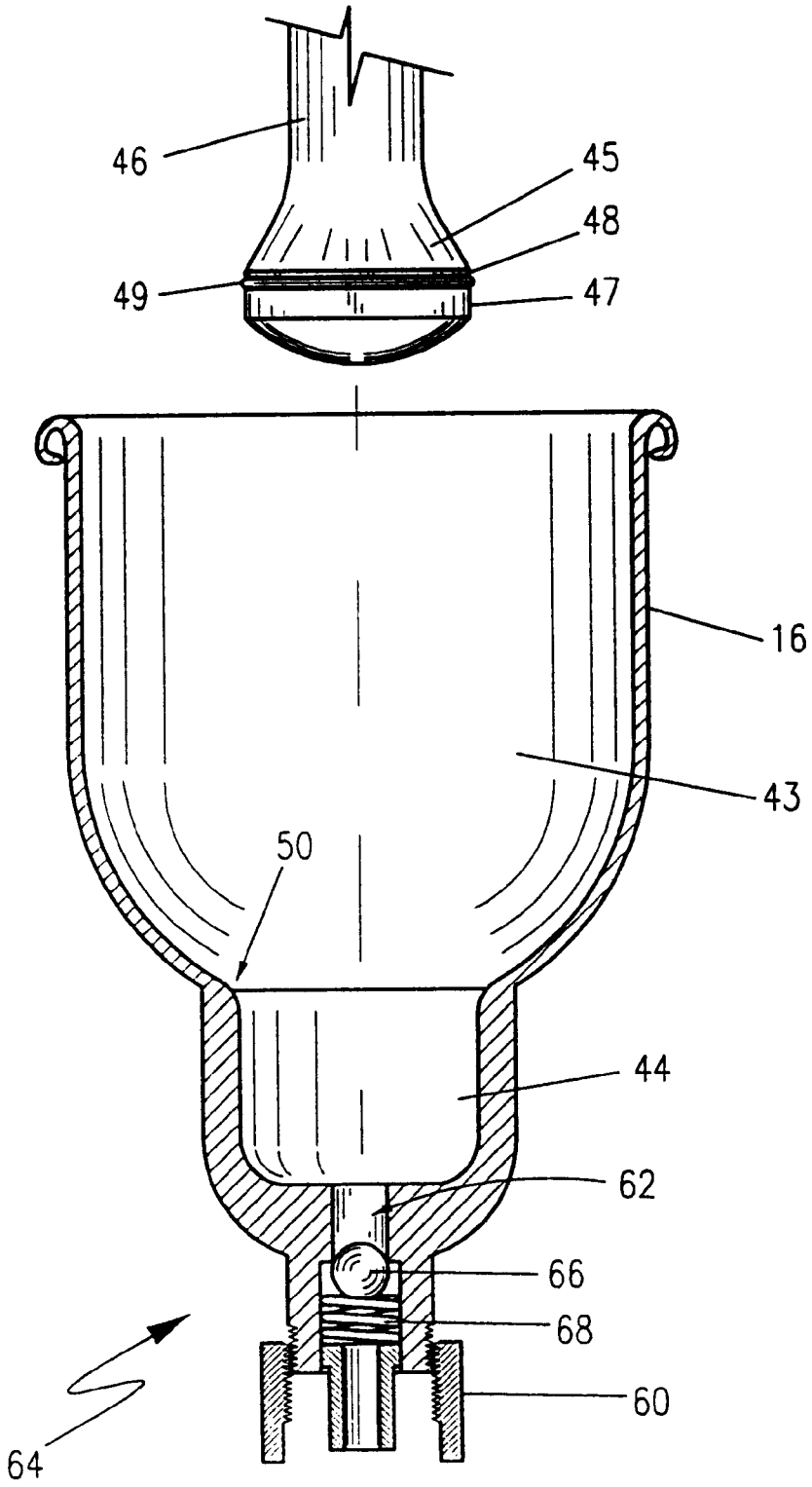
FIG. 3 is a cross sectional elevational view of the filling reservoir and piston mechanism according to the present invention.

Referring now to FIG. 3, the preferred embodiment of the can charging assembly 16 is disclosed including a liquid reservoir 43 having a tapered bottom in fluid communication with a pump rod receiving aperture 44 for receiving a main piston pump rod 45. As best shown in conjunction with FIG. 1, main piston pump rod 45 has linearly elongated shaft 46 terminating at its lower end in a radially expanded head 47. Circumscribed around the outer circumference of the head 47 is a sealing ring receiving slot 48, into which a pliable sealing ring 49 is recessed. It is envisioned that the sealing ring 49 will be formed of conventional O-ring or gasketing material.

Further shown in reference to FIG. 3, and in contrast to the prior art of FIG. 2, the receiving aperture 44 forms an upper lip 50 having a 45 degree chamfer continuing into a ½ degree taper downward into the tapered bottom. This forms a piston guide and sealing engagement means for aiding in the creating of a pressurized charging volume for the delivery of liquid contents.

Still further shown in FIG. 3, a can receiving element 60 is provided that allows the filling orifice of the can to be aligned with the discharge orifice 62 formed as a conduit penetrating the bottom of the filling reservoir. A ball check valve assembly 64, formed of a closing ball 66 urged upwardly by a check spring 68 against the opening of the discharged conduit forms a closing mechanism that allows the filing reservoir to be pressurized only by the downward motion of the piston 45, and not by releasing of propellant upward from an aerosol can. As the fluid is pressurized, the ball 66 is forced downward against the spring 68, thereby causing the flow of kinetically active fluid down into the aerosol can. In this manner, the poppet valve of a conventional pressurized aerosol can is opened by hydrodynamic lift caused by the flow of pressurized fluid into the poppet valve assembly. In this manner, no mechanical impingement of the can valve is required, thereby allowing the internal content pressure to close and seal the valve subsequent to the ceasing of fluid flow into the can. This results in a filling mechanism that prevents release of VOC and propellant, and eliminates blow-by, over pressure, or under pressure conditions.

Figure 4:
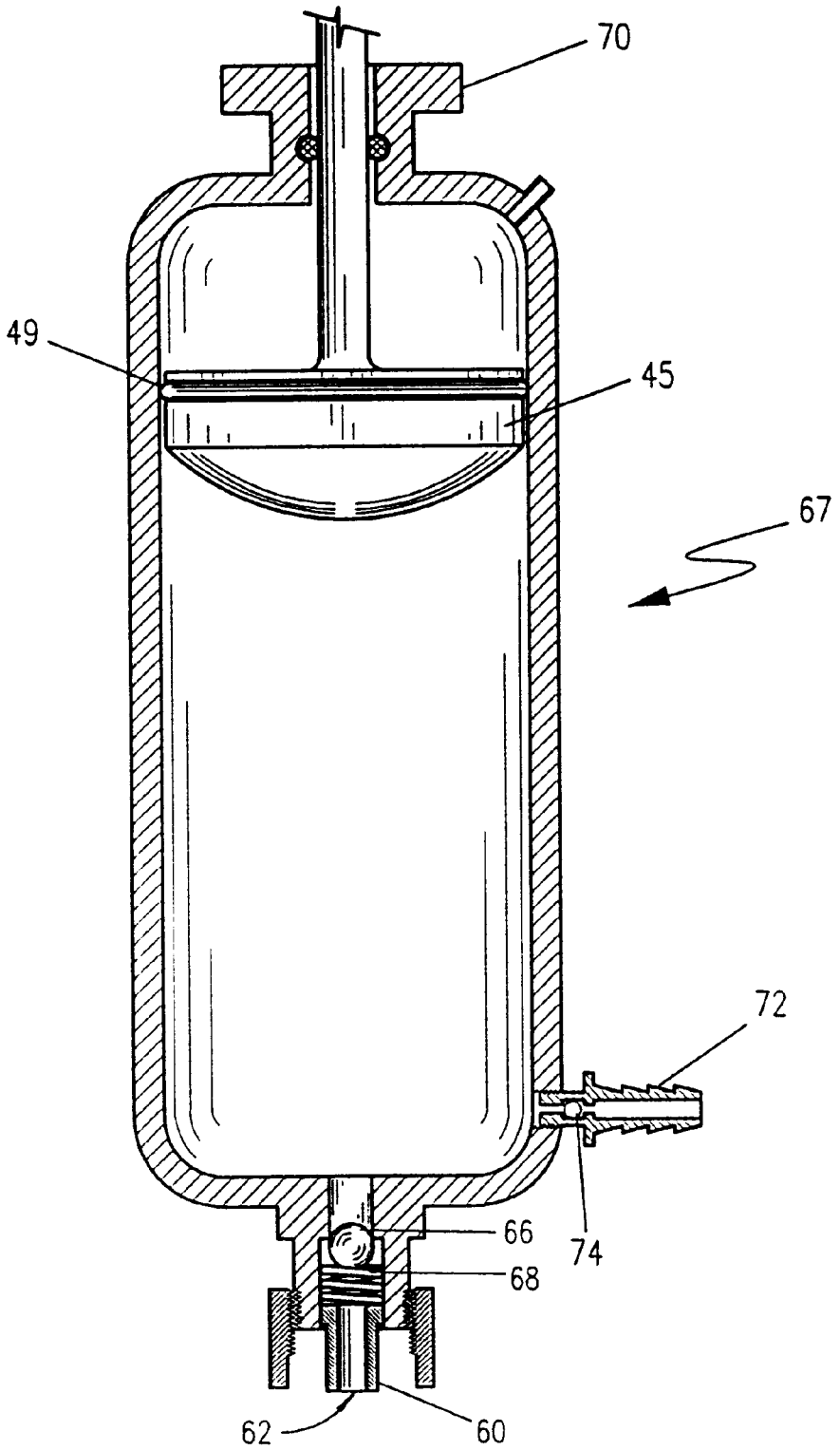
FIG. 4 is a cross sectional elevational view of an alternate embodiment for a filling reservoir and piston mechanism.

Additional teachings of the present invention can be utilized to implement many improvements in the art. By way of example and not by limitation, as best shown in FIG. 4, an alternate embodiment for a filling reservoir and piston mechanism is disclosed. In this variation, a cylinder 67 replaces the filling reservoir 16, and provides a cylindrical chamber into which the piston 45 is housed. The main piston rod and the piston have mating shoulders to define an abutting shoulder 70 in order to provide, secure, positive positioning of the piston. In this manner, the entire chamber functions as the liquid reservoir. Because this chamber is sealable, a chamber inlet 72 penetrates the lower portion of the chamber in order to provide a fluid entrance. A freely rolling, but retained ball check 74 is housed within the chamber inlet 72. The main piston pump rod has a linearly elongated shaft terminating at its lower end in a radially expanded head. Circumscribed around the outer circumference of the head is a sealing ring receiving slot, into which a pliable sealing ring is recessed. It is envisioned that the sealing ring 49 will be formed of conventional O-ring or gasketing material. Further, the fluid filling chamber 67 can be utilized to automatically draw liquid into the inlet 72 upon an upstroke of the piston 45.

Further provided, similar to the previous embodiment, is a can receiving element 60 that allows the filling orifice of the can to be aligned with the discharge orifice 62 formed as a conduit penetrating the bottom of the filling chamber. A ball check valve assembly 64, formed of a closing ball 66 urged upwardly by a check spring 68 against the opening of the discharged conduit forms a closing mechanism that allows the filing reservoir to be pressurized only by the downward motion of the piston, and not by releasing of propellant upward from an aerosol can. As the fluid is pressurized, the ball 66 is forced downward against the spring 68, thereby causing the flow of kinetically active fluid down into the aerosol can. In this manner, the poppet valve of a conventional pressurized aerosol can is opened by hydrodynamic lift caused by the flow of pressurized fluid into the poppet valve assembly. In this manner, no mechanical impingement of the can valve is required, thereby allowing the internal content pressure to close and seal the valve subsequent to the ceasing of fluid flow into the can. This results in a filling mechanism that prevents release of VOC and propellant, and eliminates blow-by, over pressure, or under pressure conditions.

The invention has been described with reference to the preferred embodiment. Obviously, modifications and alterations will occur to others upon reading and understanding the preceding specification. It is intended that the invention be construed as including all such alterations and modifications insofar as they come within the scope of the appended claims or the equivalents thereof.

What is claimed is:

1. An apparatus for charging pressurized aerosol cans with liquid comprising:

a base for providing mechanical stability to the apparatus;

a can support assembly for supporting an aerosol can being filled with liquid, wherein said can support assembly includes a can support platform that is spring biased in the upward position at a location that allows a filling orifice of a can to be mechanically forced into said can receiving element; and a retracting lever mechanically connected to said can support platform such as to allow for the operator to retract the can support platform against the urging of said spring;

a can charging assembly having a can receiving element and including a liquid reservoir having a tapered bottom in fluid communication with a pump rod receiving aperture for receiving a main piston pump rod, and wherein said main piston pump rod has a linearly elongated shaft terminating at its lower end in a radially expanded head; and wherein a can inserted into the can support assembly is automatically urged into the proper filling position and can be disengaged by depressing said lever.

2. The apparatus of claim 1, wherein said can receiving element is provided that allows the filling orifice of the can to be aligned with a discharge orifice formed as a conduit penetrating the bottom of said filling reservoir, and further comprising a ball check valve assembly formed of a closing ball urged upwardly by a check spring against the opening of the discharge conduit.

3. The apparatus of claim 1, further comprising non-contact poppet valve opening means for allowing the poppet valve of a conventional pressurized aerosol can to be opened by hydrodynamic lift caused by the flow of pressurized fluid into the poppet valve assembly, thereby allowing the internal content pressure to close and seal the valve subsequent to the ceasing of fluid flow into the can.

4. The apparatus of claim 1, wherein said filling reservoir forms a cylinder and provides a cylindrical chamber into which said piston is housed.

5. The apparatus of claim 1, wherein circumscribed around the outer circumference of said head is a sealing ring receiving slot into which a pliable sealing ring is recessed.

6. The apparatus of claim 1, wherein said liquid reservoir further comprises a receiving aperture forming an upper lip having a 45 degree chamfer continuing into a ½ degree taper downward into the tapered bottom, and wherein said receiving aperture thereby forms a piston guide and sealing engagement means for aiding in the creating of a pressurized charging volume for the delivery of liquid contents.

7. An apparatus for charging pressurized aerosol cans with liquid comprising:

a base for providing mechanical stability to the apparatus;

a can support assembly for supporting an aerosol can being filled with liquid, a can charging assembly having a can receiving element and including a liquid reservoir having a tapered bottom in fluid communication with a pump rod receiving aperture for receiving a main piston pump rod, and wherein said main piston pump rod has a linearly elongated shaft terminating at its lower end in a radially expanded head;

a chamber inlet penetrating the lower portion of the chamber in order to provide a fluid entrance; and a freely rolling, but retained ball check is housed within said chamber inlet; and wherein fluid can be freely drawn up into said chamber upon an upstroke of said piston;

and wherein said filling reservoir forms a cylinder and provides a cylindrical chamber into which said piston is housed.

* * * * *